US006318578B1

(12) United States Patent
Patterson et al.

(10) Patent No.: US 6,318,578 B1
(45) Date of Patent: Nov. 20, 2001

(54) SYSTEM OF CLOSURE FOR A POT PRESENTING A NON-CIRCULAR NECK

(75) Inventors: Robert Patterson, Ridgewood, NJ (US); Thomas Delach, Bethpage; Paul Abbatepaolo, St. James, both of NY (US)

(73) Assignee: Augros Cosmetic Packaging, Sarcelles (FR)

( * ) Notice: Subject to any disclaimer, the term of this patent is extended or adjusted under 35 U.S.C. 154(b) by 0 days.

(21) Appl. No.: 09/540,029

(22) Filed: Mar. 31, 2000

(51) Int. Cl.[7] ..... B65D 41/06

(52) U.S. Cl. ..... 220/293; 220/298; 220/301; 215/332

(58) Field of Search ..... 220/293, 294, 220/296, 297–302, DIG. 13; 215/222, 318, 332, 225, 226

(56) References Cited

U.S. PATENT DOCUMENTS 980,743 * 1/1911 Becher .
1,573,312 * 2/1926 Fritz .
2,452,230 * 10/1948 Derham .
2,542,648 * 2/1951 Flowers .
3,292,779 * 12/1966 Colella .
3,768,691 * 10/1973 Cobb et al. .
4,006,837 * 2/1977 Gates et al. .
4,858,777 * 8/1989 Morel .

* cited by examiner

*Primary Examiner*—Nathan J. Newhouse
(74) *Attorney, Agent, or Firm*—Cohen, Pontani, Lieberman & Pavane

(57) ABSTRACT

This invention relates to a device for closing a pot having a non-circular neck. The neck comprises a ring of non-circular contour presenting diametrally opposite notches for the passage of catches provided on the lower face of the skirt of a stopper. The skirt presents a non-circular cross-section. The ring presents diametrally opposite swells beneath which the catches of the skirt of the stopper are positioned.

6 Claims, 1 Drawing Sheet

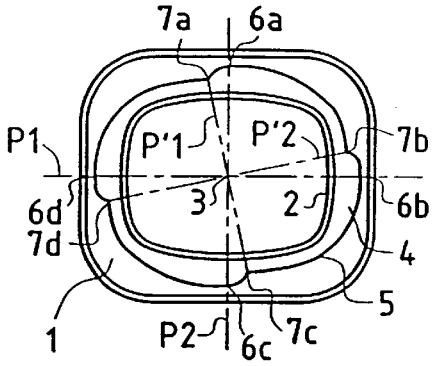
FIG.1
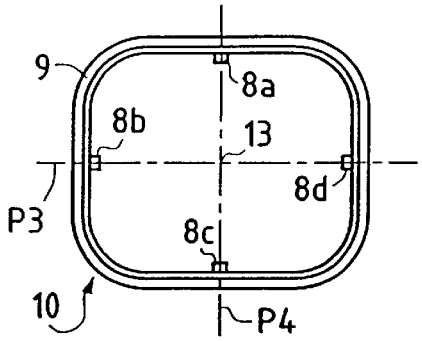
FIG.7
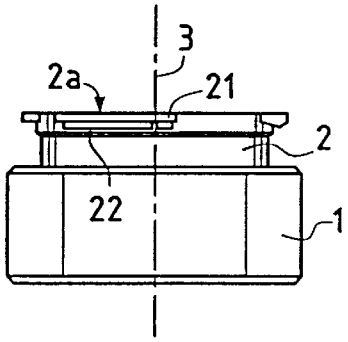
FIG.2
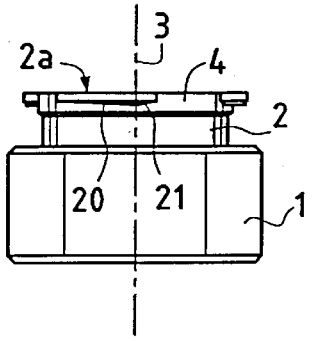
FIG.3
FIG.4
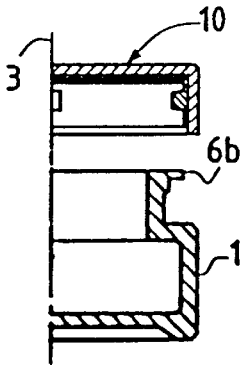
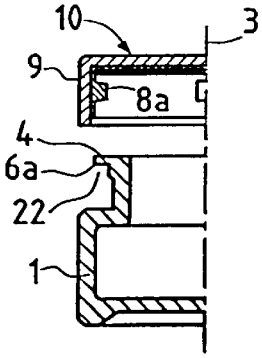
FIG.5
FIG.6
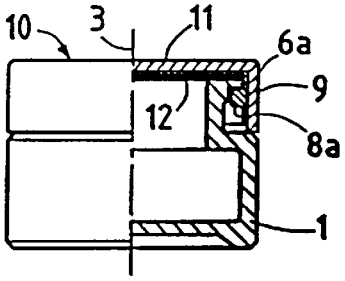

SYSTEM OF CLOSURE FOR A POT PRESENTING A NON-CIRCULAR NECK

FIELD OF THE INVENTION

The present invention relates to a pot comprising a neck capable of being obturated by a stopper presenting an upper wall applied on the end face of the neck and a peripheral skirt surrounding the neck, said neck and said skirt comprising cooperation means to allow said neck to be stopped by screwing said stopper.

It relates more particularly to pots intended for receiving cosmetic products or pasty products for body care.

Such pots may be of circular or non-circular shape for questions of aesthetics, but the necks are conventionally cylindrical in order to allow the stoppers to be screwed. In the case of pots of non-circular cross-section, the stopper is often a stopper of the quick-orientation type of which the shape of the outer wall is adapted to the shape of the pot for aesthetic reasons, but the thread of the stopper is circular.

As the neck is cylindrical, consumers have difficulty in recovering with their finger the products contained in the inside corners of the pots of non-circular cross-section, particularly if the pot is of square or rectangular cross-section, as the cross-section of the circular neck is limited.

It is an object of the present invention to minimize the incapacity of the consumers to reach the inside corners of the pots.

The invention achieves its end by reproducing the non-circular shape of the pots on their neck.

SUMMARY OF THE INVENTION

More precisely, the pot according to the invention is characterized in that the neck and the skirt of the stopper present non-circular cross-sections having respectively two orthogonal planes of symmetry passing through their axes, and in that the cooperation means comprise a ring of non-circular contour formed near the end face of the neck and extending radially towards the outside, at least two catches formed on the inner face of the skirt and lying in one of the planes of symmetry of the stopper near the inner face of the upper wall, said catches being intended to cooperate with the lower face of the ring, and the contour of the ring presenting diametrally opposite notches located in a plane offset with respect to the planes of symmetry of said neck in order to allow the passage of the catches when the stopper axially approaches the neck.

The lower face of the ring is advantageously in the form of a ramp to allow the stopper to be screwed.

In order to block the stopper in the position of closure, the lower face of the ring comprises two diametrally opposite stops, intended to block the catches in the position of screwing of the stopper, said notches being located near one of the planes of symmetry of the neck.

The stopper preferably comprises two catches in each of its planes of symmetry.

BRIEF DESCRIPTION OF THE DRAWINGS

The invention will be more readily understood on reading the following description with reference to the accompanying drawings, in which:

FIG. 1 is a plan view of the pot according to the invention.

FIG. 2 is a front view of the pot of FIG. 1.

FIG. 3 is a side view of this same pot.

FIG. 4 is a half-section along a first plane of symmetry of the pot of FIG. 1 and of its stopper.

FIG. 5 is a half-section along the second plane of symmetry of the pot of FIG. 1 and of its stopper, FIG. 6 shows, to the left, a front half-view of the pot of FIG. 1 obturated by its stopper and, to the right, a half-section of the pot obturated by the stopper, and FIG. 7 is a view of the stopper from underneath.

DESCRIPTION OF PREFERRED EMBODIMENT

Referring now to the drawings, reference 1 represents a pot of rectangular cross-section with rounded corners, which comprises a neck 2 of non-circular cross-section. The pot 1 and the neck 2 are symmetrical with respect to two orthogonal planes P1 and P2 which intersect along a vertical axis 3. The neck 2 comprises near its upper end face 2*a* a ring 4 which extends outwardly. The contour 5 of this ring 4 is non-circular and said ring presents in the planes of symmetry P1 and P2 swells 6*a*, 6*b*, 6*c*, 6*d* and, in two orthogonal planes P'1 and P'2 passing through axis 3 and offset from planes P1 and P2 by an angle close to 20° , notches 7*a*, 7*b*, 7*c*, 7*d*. The notches 7*a*, 7*b*, 7*c*, 7*d* are intended to allow passage of four catches referenced 8*a*, 8*b*, 8*c*, 8*d* formed on the inner faces of the peripheral skirt 9 of a stopper 10 intended to obturate the opening of the neck 2. The stopper 10 comprises an upper wall 11 on the inner face of which there is provided an O-ring 12 which covers in tight manner the end face 2*a* of the neck 2. The skirt 9 of the stopper 10 presents a non-circular cross-section, similar and even identical to the cross-section of the pot 1 and it comprises two orthogonal planes of symmetry P3 and P4 passing through the axis 13 of the stopper 10. Catches 8*a* and 8*c* are disposed in the plane of symmetry P3, while catches 8*b* and 8*d* lie in the plane of symmetry P4. The distances between notches 7*a* and 7*c* and between notches 7*b* and 7*d* are slightly less than the distances separating the catches 8*a* and 8*b* from catches 8*c* and 8*d*. However, the distances between the swells 6*a* and 6*c* and swells 6*b* and 6*d* are greater than the distances separating catches 8*a* and 8*b* from catches 8*c* and 8*d* and slightly less than the distances separating the respective opposite walls of the skirt 9. When the stopper 10 obturates the opening of the pot 1, plane P3 merges with plane P1 and plane P4 merges with plane P2.

The lower face 20 of the ring 4 comprises ramps 21 between each notch 7*a*, 7*b*, 7*c*, 7*d* and the closest swell 6*a*, 6*b*, 6*c*, 6*d* on which catches 8*a*, 8*b*, 8*c*, 8*d* may respectively slide.

Two diametrally opposite stops 22 are in addition provided on the lower face 20 beyond the plane of symmetry P1, in order to block the corresponding catches 8*a* and 8*b* when they are positioned in the plane of symmetry P1.

The thickness of the swells 6*a*, 6*b*, 6*c* and 6*d* is substantially equal to the distance which separates the catches 8*a*, 8*b*, 8*c* and 8*d* from the inner face of the upper wall 11 of the stopper 10 and takes into account the compressibility of the O-ring 12.

A stop 22 may obviously be provided near each swell 6*a* to 6*d*.

The distances separating the diametrally opposite swells 6*a*, 6*c* and 6*b*, 6*d* are obviously calculated as a function of the inner dimensions of the skirt 9.

The stopper 10 is placed in position on the neck 2 as follows: the neck 2 is covered by the stopper 10 by arranging for planes P3 and P4 to merge substantially with the planes P'1 and P'2 containing the notches 7*a* to 7*d*. The catches 8*a* to 8*d* may then slide in notches 7*a* to 7*d*. It then suffices to pivot the stopper 10 through about 20° in clockwise direction until the catches 8*a* and 8*b* abut against the stop walls 22. The inverse procedure is carried out in order to open the pot 1.

What is claimed is:

1. Pot comprising a neck capable of being obturated by a stopper comprising an upper wall applied on the end face of the neck and a peripheral skirt surrounding the neck, said neck and said skirt comprising cooperation means to allow said neck to be stopped by screwing said stopper, wherein said neck and said skirt present non-circular cross-sections having respectively two orthogonal planes of symmetry passing through their axes, and the cooperation means comprise a ring of non-circular contour formed near the end face of said neck and extending radially towards the outside, at least two catches formed on the inner face of the skirt and lying in one of the planes of symmetry of the stopper near the inner face of the upper wall, said catches being intended to cooperate with the lower face of the ring, and the contour of the ring presenting diametrally opposite notches located in a plane offset with respect to the planes of symmetry of said neck in order to allow the passage of the catches when the stopper axially approaches the neck.

2. The pot of claim 1, wherein the lower face of the ring is in the form of a ramp to allow the stopper to be screwed.

3. The pot of claim 2, wherein the lower face of the ring comprises two diametrally opposite stops intended to block the catches in the position of screwing of the stopper, said stops being located near one of the planes of symmetry of the neck.

4. The pot of claim 1, wherein the stopper comprises two catches in each of its planes of symmetry.

5. The pot of claim 1, wherein the inner face of the upper wall of the stopper comprises an O-ring.

6. The pot of claim 1, wherein the skirt presents a substantially rectangular cross-section with rounded corners.

* * * * *